United States Patent [19]

Martinmaas

[11] Patent Number: 4,520,698

[45] Date of Patent: Jun. 4, 1985

[54] ADJUSTABLE SOCKET FOR SOCKET WRENCHES

[76] Inventor: Werner W. Martinmaas, c/o Nevada Motorcycle Specialties, 48 Glen-Carran Cir., Sparks, Nev. 89431

[21] Appl. No.: 571,681

[22] Filed: Jan. 18, 1984

[51] Int. Cl.[3] ..... B25B 13/18

[52] U.S. Cl. ..... 81/128; 279/1 F; 279/66

[58] Field of Search ..... 81/128, 129; 279/1 F, 279/55, 68, 66

[56] References Cited

U.S. PATENT DOCUMENTS

| | | | |
|---|---|---|---|
| 583,741 | 6/1897 | Gerhardt . | |
| 1,242,097 | 10/1917 | Anderson | 81/128 |
| 1,395,585 | 11/1921 | Kizer . | |
| 1,451,873 | 4/1923 | Gellman . | |
| 1,482,075 | 1/1924 | Fisher . | |
| 1,554,963 | 9/1925 | Fisher . | |
| 2,555,836 | 6/1951 | Werich . | |
| 2,582,444 | 1/1952 | Lucht . | |
| 2,745,305 | 5/1956 | Reiffin . | |
| 2,796,791 | 6/1957 | Persson . | |
| 2,850,931 | 9/1958 | Conway . | |
| 3,195,381 | 7/1965 | Meggs, Jr. . | |
| 3,724,299 | 4/1973 | Nelson . | |
| 4,065,986 | 1/1978 | Meggs et al. . | |
| 4,151,763 | 5/1979 | Colvin | 81/128 |
| 4,213,355 | 7/1980 | Colvin . | |
| 4,325,275 | 4/1982 | Colvin | 81/128 |
| 4,366,733 | 1/1983 | Colvin . | |
| 4,378,714 | 4/1983 | Colvin | 81/128 |

*Primary Examiner*—James L. Jones, Jr.

*Attorney, Agent, or Firm*—Wood, Dalton, Phillips, Mason & Rowe

[57] ABSTRACT

An adjustable socket for a socket wrench or the like has a body member with two side plates, and between the side plates are jaw members which are concurrently movable parallel to the side plates to adjust the space between confronting jaw elements on the free ends of the jaw members. Pin and slot connections are used to change the positions of the jaw members. One embodiment of the invention provides for automatic adjustment when the socket is pushed against a hex-head fastener; and a second embodiment provides for manual adjustment by sliding an operating yoke forwardly on the body member.

13 Claims, 17 Drawing Figures

S
23
20
22
21
25
22
26
33
30
27
29
30

4.
23
43
42
20
21
22
22
25
26
27
4.
3.
3.

5.
24
23
43
42
22
25
36
34
32
41a
37
35
40a
33
40
31
27
28
5.

25
26
27
22
29
30
28
22
25
26

39
38
39a
38a
37

21
22
23
24
25
26
27
28
29
30
31
32
33
34
35
36
37
38
38a
39
39a
40
40a
41
41a
42
43
H
8.

12.
S
123
121
146
146
122
145
125
126
122
122
127
12.
128

124
13.
123
136
134
132
146
146
148
147
135
125
137
131
133
127
128
13.

124
123
136
146
146
145
145
148

125
126
122
122
135
137
14.
14.
122a
122a
122
122
142
142
128
130

ADJUSTABLE SOCKET FOR SOCKET WRENCHES

BACKGROUND OF THE INVENTION

Socket wrenches are extremely valuable tools because such wrenches have interchangeable sockets that mount upon a driving stub of a socket wrench head, and each socket makes a snug sliding fit upon a polygonal head of a rotatable threaded fastener which may be either a bolt or a nut. Such sockets may be used with any of several fastener driving tools which include a socket wrench as above stated, or a pneumatic nut driver, or a screwdriver type hand tool which has a shaft with a socket at the end.

Interchangeable sockets for fastener driving tools have been known for many years, and the principal objection to them is that a different socket is required for each different size of threaded fastener; and that drawback is greatly increased in the United States of America because of the continued use of English unit fasteners concurrently with the adoption of metric unit fasteners. The result is that at the present time a socket wrench set to fit all fasteners from about ¼" to about 2" requires an inordinate number of sockets.

Certain attempts have been made to provide an adjustable socket, but the only ones known to applicant have numerous parts and are so cumbersome that they cannot be used in many restricted spaces where socket wrenches are required.

SUMMARY OF THE INVENTION

In accordance with the invention, an adjustable socket for turning threaded fasteners that have a polygonal head comprises a body member having parallel side plates joined at a rear end to a mounting means for detachably, fixedly securing the body member to a fastener driving tool. Two jaw members are mounted between the side plates for concurrent movement parallel to the side plates, and the jaw members have facing jaw elements at their forward ends which have angularly related faces arranged to engage plural sides of a polygonal fastener head, and concurrent movement of the jaw members changes the space between the jaw elements. Control pin means is supported on the body member and is interengaged with slot means in the jaw members, the control pin means being movable along the slot means from end-to-end thereof, and being slightly movable across the slot means. The slot means are so arranged that movement of the control pin means along the slot means causes concurrent movement of the jaw members to change the space between the jaw elements, and engagement between a rear surface of the slot means and a rear surface of the pin means locks the jaw members in any attached position of adjustment. Spring means biases the jaw members to move the jaw elements toward one another and to engage said rear surfaces of the pin means and the slot means.

In a preferred embodiment of the invention the slot means in the jaw members comprise two forward slots, one in each of the two jaw members, and the forward slot means have rearward ends in register and diverged diagonally forwardly and outwardly. There are also two rearward slots, one in each of the jaw members parallel to the forward slot in said jaw member, and said slots are at an angle which is substantially less than 45° to a longitudinal plane through both jaw members.

There is a forward control pin in the forward slots and a rearward control pin in the rearward slots.

In a more preferred embodiment the forward control pin has two flat rear surfaces each of which is parallel to a rear surface of one of the forward slots, and there are interengaging teeth on the parallel rear surfaces of the forward control pin and the forward slot.

In an automatically adjustable socket embodiment of the invention the jaw members are mounted for longitudinal movement in the body member, the forward and rearward control pins are fixed to the body member side plates, and the spring means is a compression spring between the mounting means and rear ends of the jaw members. With this construction, pressure on the forward extremity of the jaw elements moves the jaw members rearwardly and increases the space between the jaw elements, so when the jaw elements are pressed against a polygonal fastener head they automatically spread until they are able to slip around the sides of the fastener head, whereupon the forward biasing action of the spring means locks the control pins and slots.

In a manually adjusted form of the device, the jaw members have registering transverse slots, a confining pin is supported on the body member side plates and is engaged in the transverse slots, a yoke is supported for longitudinal movement on the body member and has a knurled finger piece, the control pins are fixed in the yoke, and the spring means is a pair of compression springs that bear on a forward part of the body member and on the forward control pin. With this construction forward manual movement of the yoke moves the jaw members transversely outwardly to increase the space between the jaw elements, and the spring means biases the yoke rearwardly to normally close the jaw elements.

The present adjustable socket structure is sufficiently compact that it can be used in quite restricted spaces, and three such adjustable sockets can cover a very wide range of both U.S. and metric sizes, thus eliminating the need for many different size sockets.

THE DRAWINGS

DETAILED DESCRIPTION OF THE INVENTION

Figures 1, 2, 3, 4, 17:
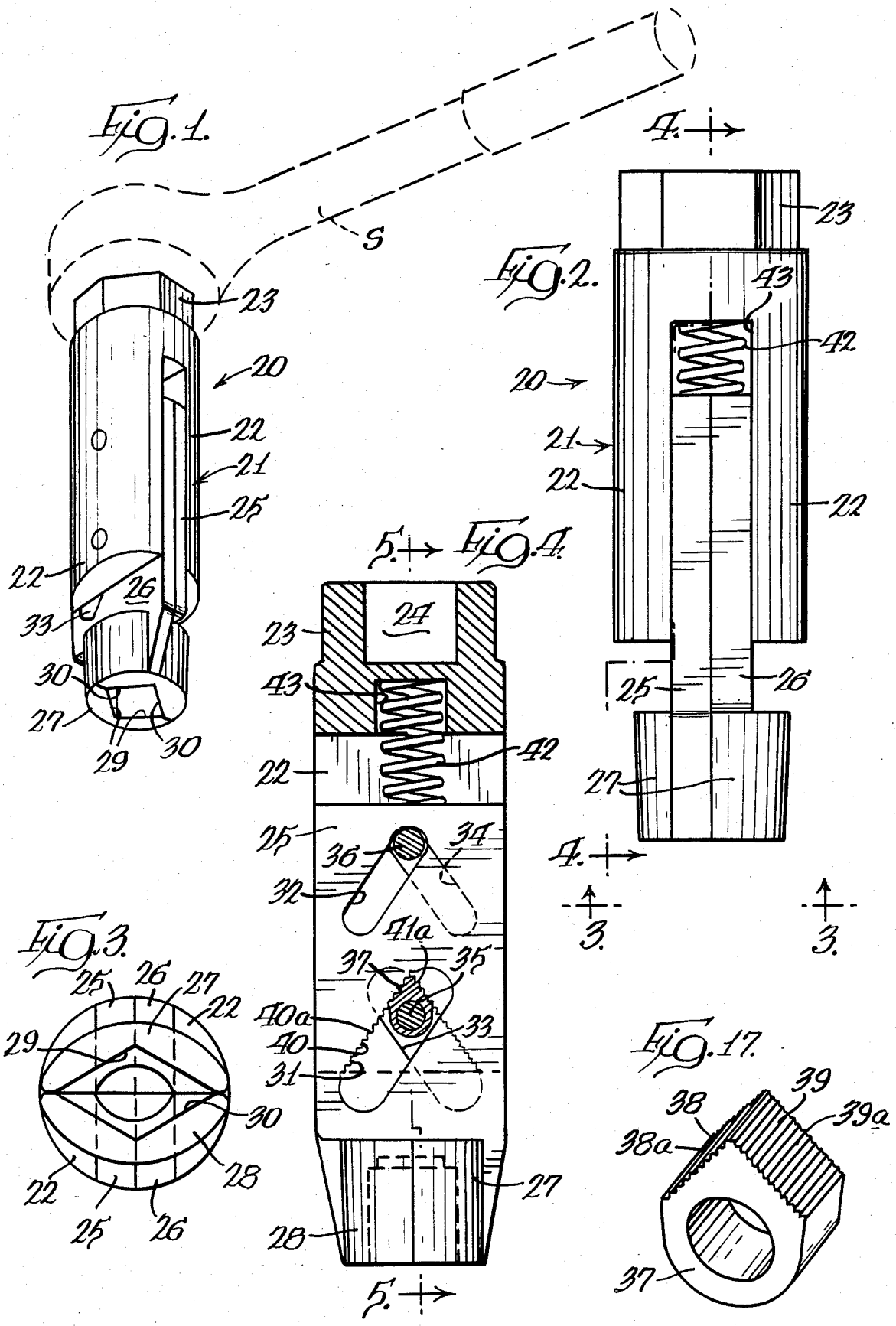
FIG. 1 is a perspective view of an automatically adjustable socket embodying the invention, connected to a socket wrench which is illustrated in broken lines.
FIG. 2 is an enlarged side elevational view of the automatically adjustable socket of FIG. 1.
FIG. 3 is a front end elevational view taken as indicated along the line 3—3 of FIG. 2.
FIG. 4 is a longitudinal sectional view taken substantially as indicated along the line 4—4 of FIG. 2.
FIG. 17 is a greatly enlarged perspective view of a collar which provides the flat, toothed rear surfaces of the forward control pin.

Referring to the drawings in detail, and referring first to FIGS. 1 to 10 which illustrate an automatically adjustable socket embodying the invention, an automatically adjustable socket, indicated generally at 20, has a body member, indicated generally at 21, which has parallel side plates 22 joined at a rear end to a mounting means 23 which has a hexagonal outer perimeter and a square central well 24 to receive a standard square stub (not shown) of a socket wrench S. Illustration of a socket wrench is purely a matter of convenience, since the automatically adjustable socket 20 can also be used with a pneumatic torque wrench of the type commonly used in industrial assembly work; or the automatically adjustable socket 20 may also be used with a screwdriver type of fastener driving tool.

Figures 5, 6, 7, 8, 9, 10:
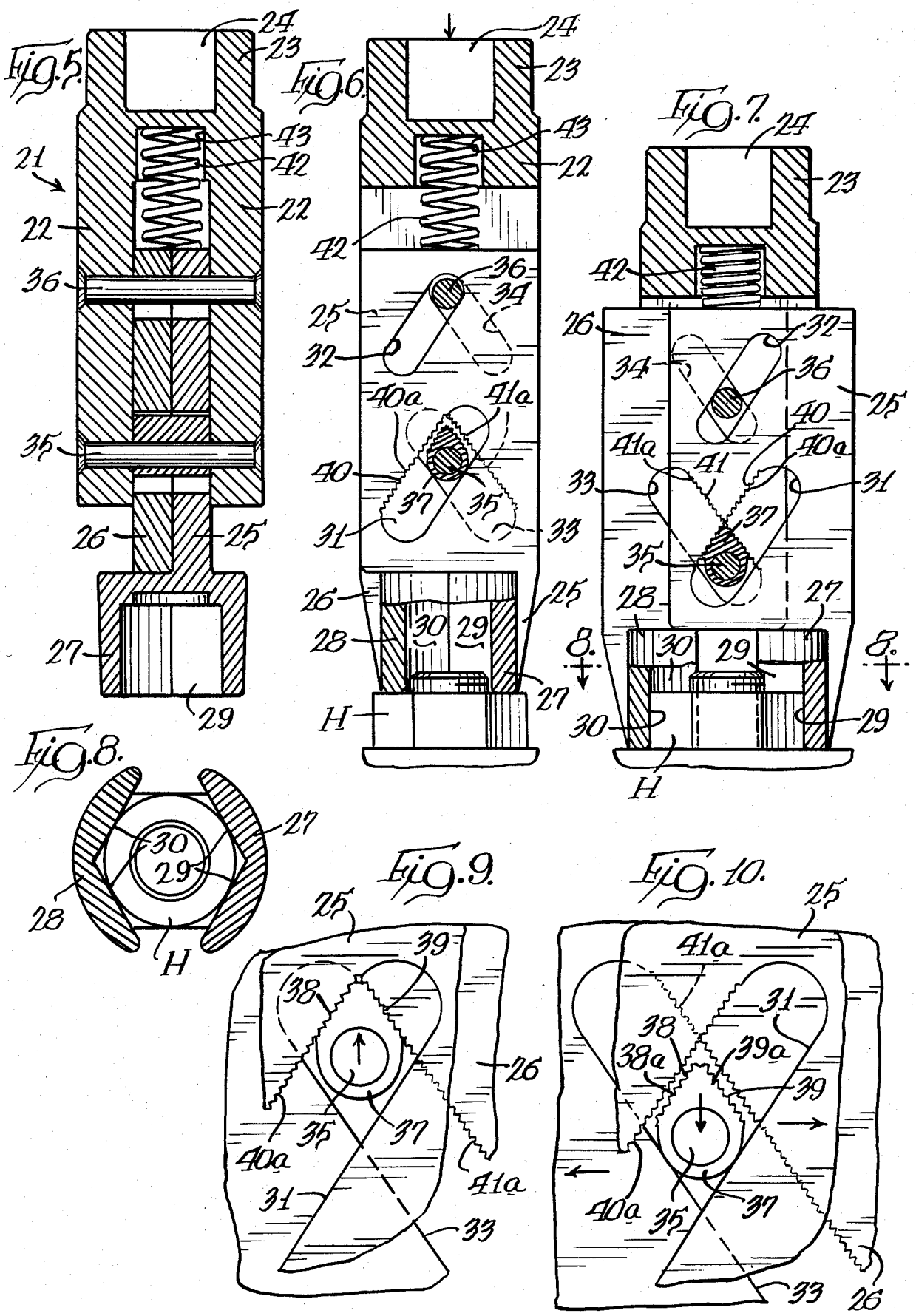
FIG. 5 is a longitudinal sectional view taken substantially as indicated along the line 5—5 of FIG. 4.
FIG. 6 is a view similar to FIG. 4, with the jaw elements partly in section and bearing upon a hex nut which is larger than the span across the jaw elements.
FIG. 7 is a view similar to FIG. 6, illustrating the position of the parts when the jaw members have been forced rearwardly and the jaw elements have expanded to embrace the hex nut.
FIG. 8 is a sectional view taken substantially as indicated along the line 8—8 of FIG. 7.
FIG. 9 is a schematic view illustrating how the biasing of the spring to move the body member upwardly with respect to the jaw members engages the teeth on the rear of the forward control pin with teeth on the rear of the forward slots.
FIG. 10 is a schematic view showing how force applied to the mounting means on the end of the body disengages the teeth on the rear surfaces of the forward control pin from the teeth in the rear surfaces of forward slots, and permits the jaw members to move outwardly to increase the span across the jaw elements.
Figure 11:
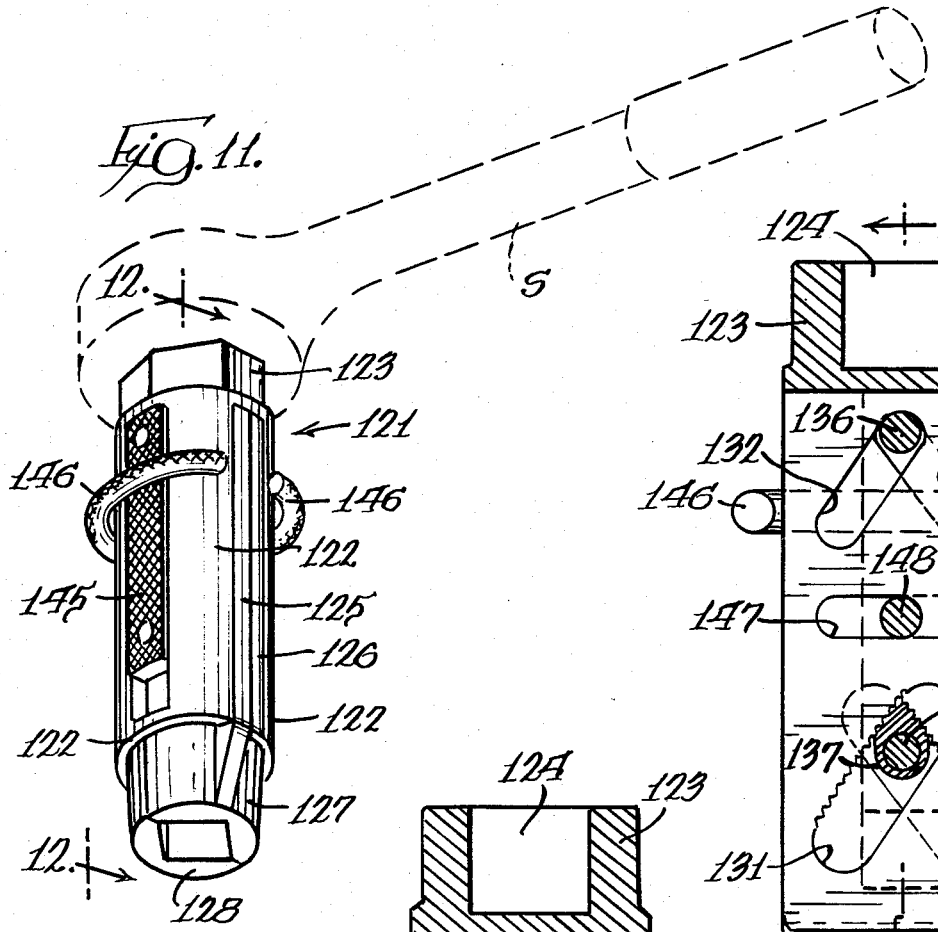
FIG. 11 is a perspective view of a manually adjustable socket embodying the invention, connected to a socket wrench which is illustrated in broken lines.

Two jaw members 25 and 26 are mounted between the side plates 22 for concurrent movement parallel to the side plates, and at the forward ends of the jaw members 25 and 26 are facing jaw elements 27 and 28, and angularly related faces 29 on the jaw element 27 and 30 on the jaw element 28 engage plural sides of a polygonal fastener head such as a hex nut H which is illustrated in FIGS. 6 and 7.

Referring now particularly to FIGS. 2-7, the jaw members 25 and 26 are mounted for movement parallel to the side plates 22 of the body member 21, and in the automatically adjustable embodiment of the invention the jaw members are movable both longitudinally and laterally. The jaw member 25 has a diagonal forward slot 31 and a diagonal rearward slot 32 which is parallel to the slot 31. The jaw member 26 has a diagonal forward slot 33 and a diagonal rearward slot 34 which is parallel to the slot 33. The slots 31 and 33 and the slots 32 and 34 have their rear ends in register in the maximum closed position of the jaw elements 27 and 28, as seen in FIGS. 4 and 6; and the slots 31 and 32 extend in a direction opposite to the slots 33 and 34, with all four slots being at an angle of about 35° to a longitudinal median plane of the body member 21.

A forward control pin 35 and a rearward control pin 36 are mounted in the body member side plates 22 and extend, respectively, through the forward slots 31-33 and through the rearward slots 32-34. The control pins 35 and 36 are in the form of rivets which prevent spreading of the body side plates 22 under load.

The forward control pin 35 includes a fixed bushing 37 (see FIG. 17) which has a flat surface 38 provided with teeth 38*a* and a flat surface 39 provided with teeth 39*a*. The surfaces 38 and 39 are parallel, respectively, to rearward surfaces 40 and 41 of the respective forward slots 31 and 33, and the teeth 38*a* and 39*a* are releasably engageable with respective teeth 40*a* and 41*a* in the surfaces 40 and 41.

A compression spring 42 seats in a well 43 in the front of the mounting means 23 of the body member 21 and bears upon the rear ends of the jaw members 25 and 26 so as to normally bias the jaw members to the position illustrated in FIGS. 1 to 6, in which the jaw elements 27 and 28 are closed against one another. The biasing action of the spring 42 on the jaw members 25 and 26 also tends to engage the forward control pin teeth 38*a* and 39*a* with the respective slot teeth 40*a* and 41*a*, while rearward pressure upon the jaw elements 27 and 28 which tends to move the control pins along the slots also moves the slots downwardly with respect to the control pins so as to disengage the teeth.

In the normal position of the jaw members illustrated in FIGS. 4-6, the rearward control pin 36 is seated in the rear ends of the slots 32 and 34, and the forward control pin 35 has its teeth 38*a* and 39*a* disengaged from the teeth 40*a* and 41*a* by reason of a slight freedom of the pins to move across the slots.

As seen in FIGS. 6 and 7, to spread the jaw elements 27 and 28 to fit around a hex nut H, all that is required is to exert pressure on the rear of the mounting means 23 so the control pins slide along the respective slot, as is clearly seen by comparing FIG. 6, where forward movement of the body member 21 has not yet started, with FIG. 7 where forward movement of the body member has moved the jaw members 25 and 26 laterally to permit the jaw elements 27 and 28 to slide around the sides of the hex hut H. As soon as forward force on the adjustable socket is terminated, the biasing action of the spring 42 engages the teeth 38*a* and 39*a* with the teeth 40*a* and 41*a* to hold the jaw members 25 and 26 in their attained position. The above-described function of the forward control pin 35 and the forward slots 31 and 32 is best seen in the diagrammatic showing of FIGS. 9 and 10.

Referring now to the manually adjustable socket illustrated in FIGS. 11-16, parts which perform functions comparable to those of various parts of the automatically adjustable embodiment are given the same reference numerals but one hundred numbers higher; and in the following detailed description it is principally the differences in structure and function that are described.

A body member, indicated generally at 121, has side plates 122 which are provided with external longitudinal slots 122*a* to accommodate a manual operating yoke 145 that is provided with knurled finger pieces 146.

Jaw members 125 and 126 are provided with registering transverse slots 147, and a confining pin 148 extends through the transverse slots 147 so as to restrict the jaw members 125 and 126 to concurrent lateral movement in the body member 121.

Mounted in the yoke 145 are forward control pins 135 and rearward control pins 136 which extend, respectively, through forward slots and rearward slots in the jaw members 125 and 126. The control pins 135 and 136 and the forward and rearward slots in the jaw members 125 and 126 are identical in structure, interrelationship, and function with the control pins and slots of the automatic embodiment of the socket, so are not again described in detail.

Figure 12:
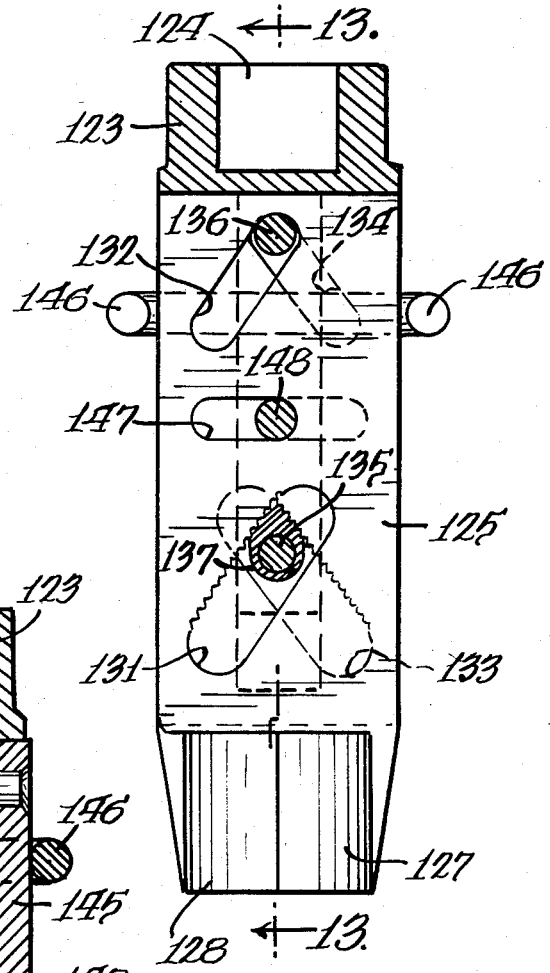
FIG. 12 is a fragmentary sectional view on an enlarged scale taken substantially as indicated along the line 12—12 of FIG. 11.
Figure 13:
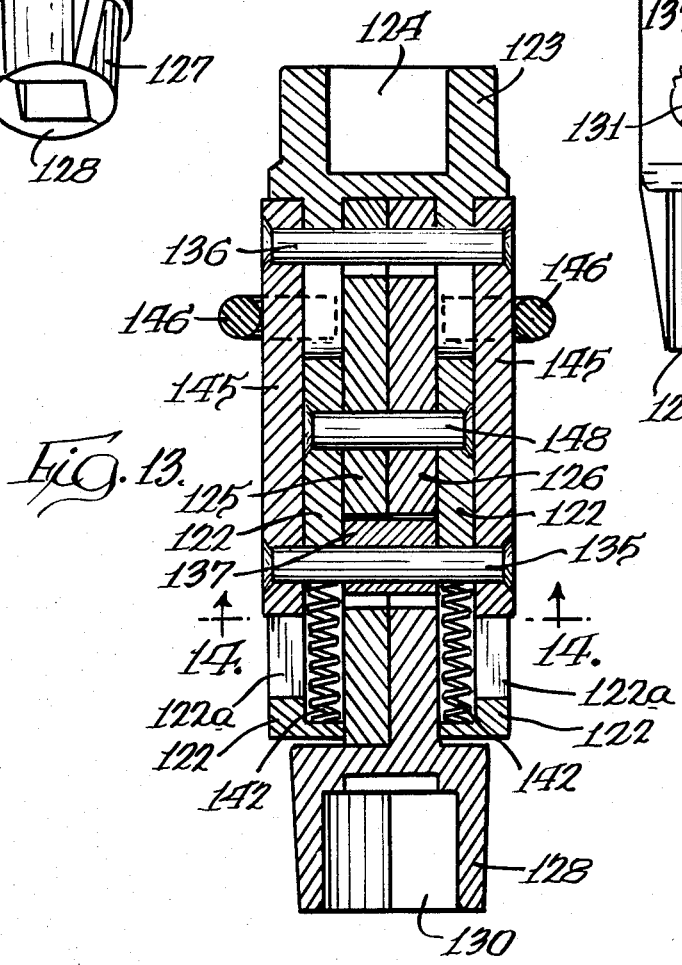
FIG. 13 is a sectional view taken substantially as indicated along the line 13—13 of FIG. 12.
Figure 14:
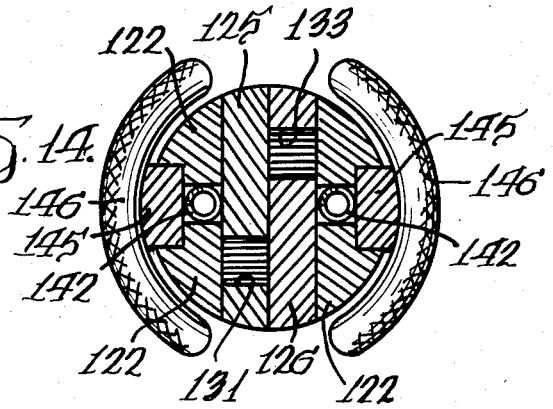
FIG. 14 is a sectional view taken substantially as indicated along the line 14—14 of FIG. 13.
Figure 15:
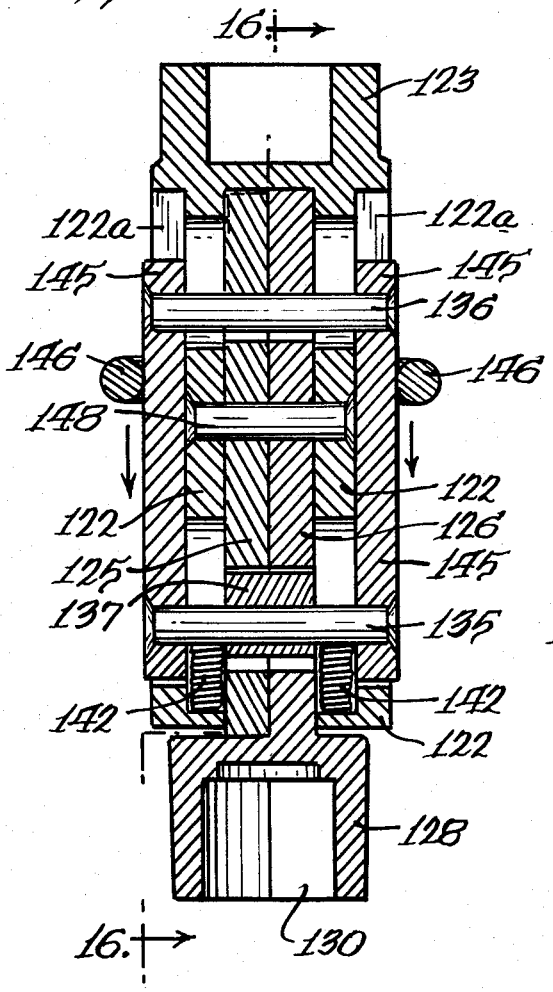
FIG. 15 is a view like FIG. 13 with the yoke moved a substantial distance toward the front of the socket to increase the space between the jaw elements.
Figure 16:
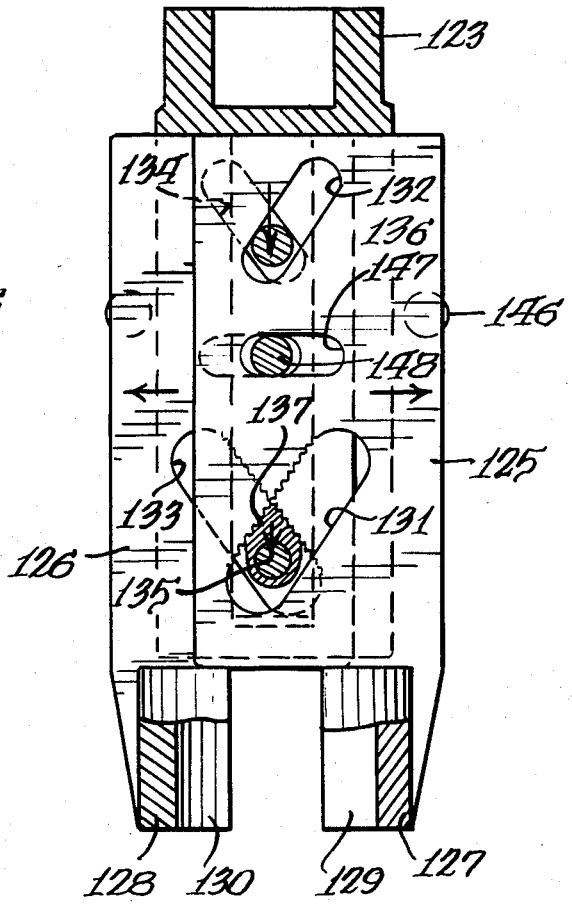
FIG. 16 is a sectional view taken substantially as indicated along the line 16—16 of FIG. 15.

Compression springs 142 are mounted in a well at the front of the body member 121 and bear upon the forward control pin 135 as seen in FIGS. 13 and 15, so the springs 142 bias the yoke 145 rearwardly and locate the control pins 135 and 136 in the rear ends of the jaw member slots as seen in FIGS. 12 and 13. Manual forward pressure applied to the knurled finger pieces 146 slides the yoke 145 forwardly to separate jaw elements 127 and 128 of the jaw members, as is clearly seen by comparing FIGS. 12 and 16. Thus, the mechanical function for adjusting the jaw elements 127 and 128 of the manual embodiment of the socket is identical with that in the automatic embodiment, the differences residing solely in the mechanism by which the movement of the jaw members is produced.

The foregoing detailed description is given for clearness of understanding only and no unnecessary limitations should be understood therefrom, as modifications will be obvious to those skilled in the art.

I claim:

1. An adjustable socket for turning threaded fasteners that have a polygonal head, said socket comprising, in combination:

a body member having parallel side plates joined at a rear end to a mounting means for detachably, fixedly securing said body member to a fastener driving tool;

two jaw members mounted between said side plates for concurrent movement parallel to the side plates, said jaw members having facing jaw elements which are at forward ends of said jaw members and have angularly related faces arranged to engage plural sides of a polygonal fastener head, concurrent movement of said jaw members changing the space between said jaw elements;

control pin means supported on the body member and interengaged with slot means in the jaw members, said control pin means being movable along said slot means from end to end thereof, and being slightly movable across the slot means, said slot means being arranged so that movement of said control pin means along said slot means causes concurrent movement of the jaw members to change the space between the jaw elements, and engagement between a rear surface of said slot means and a rear surface of said pin means locks the jaw members in any attained position of adjustment;

and spring means biasing the jaw members to move the jaw elements toward one another and engage said rear surfaces.

2. The combination of claim 1 in which the slot means in the jaw members comprises two forward slots, one in each of the two jaw members, which have rearward ends in register and which diverge diagonally forwardly and outwardly, and two rearward slots, one in each of said jaw members parallel to the forward slot in said jaw member, said slots being at an angle which is substantially less than 45° to a longitudinal plane through both jaw members, and the control pin means comprises a forward control pin in said forward slots and a rearward control pin in said rearward slots.

3. The combination of claim 2 in which the forward control pin has two flat rear surfaces, each of said flat rear surfaces being parallel to the rear surface of one of the forward slots.

4. The combination of claim 3 which includes interengaging teeth on said parallel rear surfaces of said forward control pin and said forward slots.

5. The combination of claim 3 in which the forward control pin has a cylindrical surface between said flat rear surfaces, and the rearward control pin is cylindrical.

6. The combination of claim 3 in which the jaw members are mounted for longitudinal movement in the body member, the forward and rearward control pins are fixed to the body member side plates, and the spring means is a compression spring between the mounting means and rear ends of the jaw members, whereby pressure on the forward extremity of the jaw elements moves said jaw members rearwardly and increases the space between the jaw elements.

7. The combination of claim 6 which includes interengaging teeth on said parallel rear surfaces of said forward control pin and said forward slots.

8. The combination of claim 1 in which the jaw members are mounted for longitudinal movement in the body member, the control pin means is fixed to the body member side plates, and the spring means is a compression spring between the mounting means and the rear ends of the jaw members, whereby pressure on the forward extremity of the jaw elements moves said jaw members rearwardly and increases the space between the jaw elements.

9. The combination of claim 8 in which said rear surfaces of said slot means and said control pin means are provided with interengaging teeth.

10. The combination of claim 3 in which the jaw members have registering transverse slots, a confining pin is supported on the body member side plates and is engaged in said transverse slots, a yoke is supported for longitudinal movement on the body member and has a knurled finger piece, the forward and rearward control pins are fixed in the yoke, and the spring means is a pair of compression springs that bear on a forward part of the body member and on the forward control pin, whereby forward manual movement of the yoke moves the jaw members transversely outwardly and increases the space between the jaw elements.

11. The combination of claim 10 which includes interengaging teeth on said parallel rear surfaces of said forward control pin and said forward slots.

12. The combination of claim 1 in which the jaw members have registering transverse slots, a confining pin is supported on the body member side plates and is engaged in one of said transverse slots, a yoke is supported for longitudinal movement on the body member and has a knurled finger piece, the control pin means is fixed in a yoke, and the spring means is a pair of compression springs that bear on a forward part of the body member and on the control pin means, whereby forward manual movement of the yoke moves the jaw members transversely outwardly and increases the space between the jaw elements.

13. The combination of claim 12 in which said rear surfaces of said slot means and said control pin means are provided with interengaging teeth.

* * * * *